US007481602B2

(12) United States Patent
Lampley et al.

(10) Patent No.: US 7,481,602 B2
(45) Date of Patent: Jan. 27, 2009

(54) DIAMOND TROWEL BLADE

(76) Inventors: Leonard A. Lampley, 7109 Lob Lolly Pine Blvd., Suite 100, Fairview, TN (US) 37062; Tyron B. Draper, 1505 Sweetbriar Ave., Nashville, TN (US) 37212

( * ) Notice: Subject to any disclaimer, the term of this patent is extended or adjusted under 35 U.S.C. 154(b) by 295 days.

(21) Appl. No.: 11/391,853

(22) Filed: Mar. 29, 2006

(65) Prior Publication Data

US 2006/0188334 A1 Aug. 24, 2006

Related U.S. Application Data

(63) Continuation-in-part of application No. 10/919,047, filed on Aug. 16, 2004, now Pat. No. 7,255,513.

(51) Int. Cl.
*E01C 23/088* (2006.01)
*E01C 23/085* (2006.01)

(52) U.S. Cl. ..... 404/112

(58) Field of Classification Search ..... 404/112
See application file for complete search history.

(56) References Cited

U.S. PATENT DOCUMENTS

| | | | | |
|---|---|---|---|---|
| 2,309,016 | A | | 1/1943 | Ryan |
| 3,934,377 | A | | 1/1976 | Tertinek |
| 3,936,212 | A | | 2/1976 | Holz, Sr. et al. |
| 4,155,721 | A | * | 5/1979 | Fletcher ..... 51/295 |
| 5,454,751 | A | | 10/1995 | Wiand |
| 5,480,258 | A | | 1/1996 | Allen |
| 5,564,634 | A | | 10/1996 | Rouse et al. |
| 5,567,503 | A | | 10/1996 | Sexton et al. |
| 5,605,493 | A | | 2/1997 | Donatelli et al. |
| 6,039,641 | A | | 3/2000 | Sung |
| 6,058,922 | A | | 5/2000 | Sexton |
| 6,155,907 | A | | 12/2000 | Jones |
| 6,238,277 | B1 | | 5/2001 | Duncan et al. |
| 6,238,448 | B1 | | 5/2001 | Rouse et al. |
| 6,475,067 | B1 | | 11/2002 | Jones et al. |
| RE38,364 | E | | 12/2003 | Wetherell et al. |

* cited by examiner

*Primary Examiner*—Raymond W Addie
(74) *Attorney, Agent, or Firm*—James Addison Barry, Jr.

(57) ABSTRACT

A diamond trowel blade 20 comprises diamond particles that will attach to a power trowel for surface preparation of hardened concrete surfaces. The diamond trowel blade 20 includes a diamond bearing surface 22; a backing plate 24; an intermediate layer 28; and a mounting means 26 for attaching the trowel blade 20 to the power trowel. A method for mechanically preparing a concrete surface with a diamond trowel blade 20 attached to a power trowel including the surface preparing steps of: attaching the diamond trowel blade 20 with the power trowel; selecting the diamond trowel blade 20 with the appropriate grit for the concrete surface; directing the rotating diamond trowel blade 20 over the surface until the smoothness is attained for the particular grit in use; and repeating the steps of selecting, directing, and repeating until the user achieves the smoothness desired.

14 Claims, 8 Drawing Sheets

DIAMOND TROWEL BLADE

CROSS-REFERENCE

The present application is a Continuation-In-Part of the parent U.S. patent application Ser. No. 10/919,047, filed Aug. 16, 2004, now U.S. Pat. No. 7,255,513 titled Diamond Trowel Blade. The present application is related by the same inventors for both applications, Leonard A. Lampley and Tyron B. Draper. The parent application U.S. patent application Ser. No. 10/919,047, filed Aug. 16, 2004 is hereby incorporated in its entirety by reference.

BACKGROUND (1) Technical Field

The present invention relates to a diamond trowel blade. More particularly, this invention relates to a concrete surface preparing trowel blade with diamond particles and a method of using a diamond trowel blade to prepare a concrete surface.

(2) Background

Concrete is one of the most widely used construction materials. Because of its strength, durability, ease of manufacture, ease of installation, and relatively low cost, it is frequently the material of choice for floors, walls, and the like. However, there are many instances where it is desirable to have a floor or wall surface with a pleasing high gloss finish or shine. In such cases, concrete may be overlooked in favor of other more high cost materials such as marble, stone, terrazzo, etc. Color concrete flooring has become very popular replacing the flooring materials previously mentioned as well as low cost tile flooring applications.

In pouring wet concrete, several steps are required to insure a smooth concrete surface finish after the concrete has partially dried. When the concrete is still in semi-fluid form, it is initially screeded through the use of a screed board or long wooden plank. Screeding is required to bring the wet concrete surface to a roughly equal height. Once the concrete is initially set at this height, the surface of the concrete is then treated with a float. The floating operation is used to settle large stones, smooth out the surface of the wet concrete, and settle the larger stones below the surface. After the float operation is performed and the concrete has partially dried, the freshly poured concrete may be troweled in order to bring the surface to a smooth finish. Utilizing a trowel machine with a plurality of blades, the surface of the concrete which is in a partially dried condition is contacted by the rotating blades of the trowel machine and produces a smooth finish surface on the concrete which is free of bubbles and also allows for evaporation of water which may rise to the surface. However, troweling needs to be completed prior to the concrete becoming too hard. Once the freshly poured concrete has hardened, the troweling machine and its corresponding flat blades will not sufficiently smooth the concrete surface.

Color concrete floors have some drawbacks when preparing the surface that include: 1) trowel machines may burn or take the color out of the color concrete floor if used too long while trying to take out imperfections; and 2) color concrete floors must be left in an imperfect or rough finish to harden to avoid burning the floor or taking the color out of the color concrete flooring. There is a need for a device and a method for preparing the concrete surface after the concrete has hardened.

In the past power trowel machines with trowel blades as well as grinding machines with grinding blades have been attempted in numerous ways. U.S. Pat. No. 3,936,212 titled "Ride-Type Surface-Working Machines" and U.S. Pat. No. 5,480,258 titled "Variable Width, Twin Engine Riding Trowel" depict an example of a riding troweling machine for finishing large areas of concrete flooring utilizing traditional trowel blades. U.S. Pat. No. 5,480,258 also depicts a power trowel machine that is expanded to receive finishing pans on the blades of the rotors. U.S. Pat. No. 3,934,377 titled "Concrete Surface Grinder"; U.S. Pat. No. 5,605,493 titled "Stone Polishing Apparatus and Method"; and U.S. Pat. No. 6,238,277 titled "Multidisc Floor Grinder" are examples of rotary concrete surface grinding and smoothing devices having engine driven, and a rotating grinding head. Using these machines requires the additional expense of having both a grinder and a trowel machine for finishing concrete surfaces. U.S. Pat. No. 5,567,503 titled "Polishing Pad with Abrasive Particles in a Non-Porous Binder" discloses a polishing pad of ultra-hard abrasive particles such as diamond or cubic boron nitride for use with non-porous thermoplastic polymers in polishing very had stones such as granite. These pads are designed for very hard stone and do not work as well for concrete surfaces with numerous imperfections. U.S. Pat. No. 6,058,922 titled "Grinding Blade for Trowel Machine" converts the trowel machine to a grinding machine by sliding a device with a grinding stone attached to the device over each trowel blade.

There have also been various methods attempted to finish concrete floors. U.S. Pat. No. 6,155,907 reissued as RE38,364 E titled "Method for Hardening and Polishing Concrete Floors, Walls, and the Like" discloses a method of hardening and polishing a concrete surface by applying a hardening/densifying silicate compound, allowing the chemical to soak into the surface of the concrete, drying the surface, applying a polishing compound and mechanically polishing the concrete surface. This patent also discloses other methods that all include a step of applying silicate polishing compounds or applying a hardening/densifying silicate compounds or both. U.S. Pat. No. 6,475,067 titled "Dry Method of Concrete Floor Restoration" discloses a method for restoring a concrete surface by dry grinding a concrete surface using a grinding grit, extracting the dust generated, repeating the dry grinding and applying a sealer. This process uses rotating diamond grinding disks that remove existing floor coatings or smooth out ruts or pitted concrete floor slabs attached to grinding machines such as the HTC-800 available from HTC Sweden. However, this method uses additional grinding machines and applies sealer coats after grinding.

In order to take advantage of color concrete flooring and avoid the drawbacks there is a need for a device that: 1) can attach to a walk behind trowel machine or a ride able trowel machine; 2) can prepare surfaces of hardened concrete; 3) is inexpensive; and 4) incorporates natural or synthetic diamond abrasive particles.

SUMMARY OF THE INVENTION

The present invention is a device that: 1) can attach to a walk behind trowel machine or a ride able trowel machine; 2) can prepare surfaces of hardened concrete; 3) is inexpensive; and 4) incorporates natural or synthetic diamond abrasive particles.

The present invention is a concrete finish trowel blade to be used with a handheld, walk behind, and/or rideable power trowel. The trowel blade is fixed temporarily or permanently with natural or synthetic diamond particles through the medium of diamond impregnated segments; electroplating; CVD; and/or impregnated resin bonds. These trowel blades are used in surface preparation, grinding, polishing, and/or flattening new or existing concrete floors. It consists of a trowel blade with diamond particles that will attach to a power trowel for surface preparation of hardened concrete, including a backing plate; a diamond bearing surface for preparing the concrete surface attached to the backing plate; an intermediate layer; and an attachment means for attaching the diamond trowel blade to the power trowel.

The present invention also comprises the provision of a method for mechanically preparing a concrete surface with a diamond trowel blade attached to a power trowel, the method includes the surface preparing steps of selecting the diamond trowel blade with the appropriate grit for the concrete surface, installing the diamond trowel blades on the power trowel, and directing the rotating diamond trowel blade over the surface until the smoothness is attained for the particular grit of the diamond trowel blade in use; and repeating the steps for surface preparing until the user achieves the smoothness desired.

BRIEF DESCRIPTION OF THE DRAWINGS

The objects, features and advantages of the present invention will be apparent from the following detailed descriptions of various aspects of the invention in conjunction with reference to the following drawings, where.

DETAILED DESCRIPTION

The present invention is a concrete finish trowel blade to be used with a handheld, walk behind, and/or rideable power trowel. The trowel blade is fixed temporarily or permanently with natural or synthetic diamond particles through the medium of diamond impregnated segments; electroplating; chemical vapor deposition (CVD); and/or impregnated resin bonds. These trowel blades are used in surface preparation, grinding, polishing, and/or flattening new or existing concrete floors. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein, may be applied to a wide range of aspects. Thus, the present invention is not intended to be limited to the aspects presented, but is to be accorded the widest scope consistent with the principles and novel features disclosed herein. Furthermore, it should be noted that, unless explicitly stated otherwise, the figures included herein are illustrated diagrammatically and without any specific scale, as they are provided as qualitative illustrations of the concept of the present invention.

(1) Introduction

Figure 1:
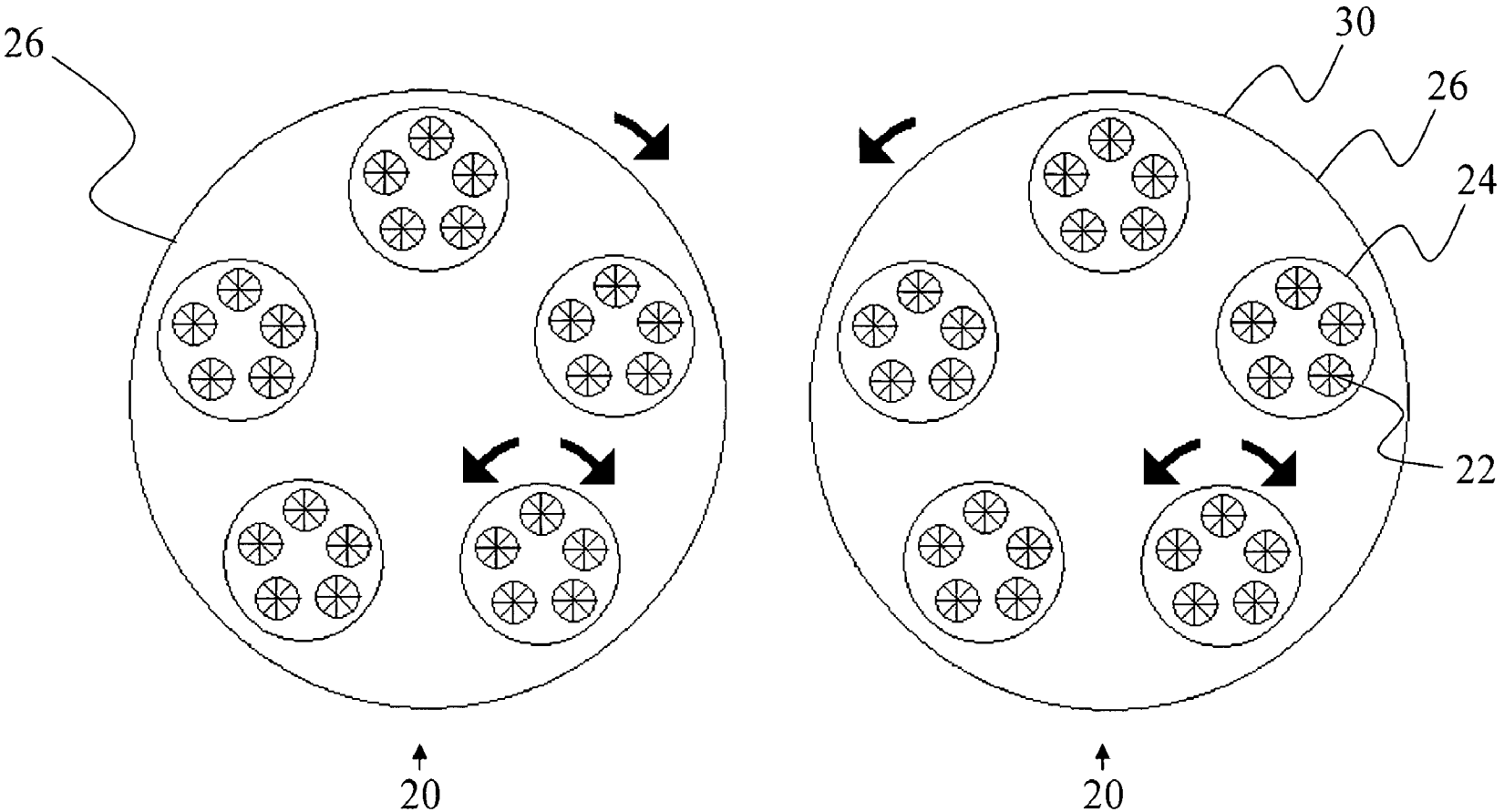
FIG. 1 is a bottom plan view of the present invention depicting a diamond trowel blade.

An embodiment of the present invention is depicted in FIG. 1, and includes a diamond trowel blade 20 and a method to prepare a concrete surface using the diamond trowel blade 20. The diamond trowel blade 20 is manufactured in various grit scales from very coarse to ultra fine depending on the roughness of the concrete surface and the smoothness desired. The diamond trowel blade 20 has different embodiments depending on the application. The embodiments may include different attachment means. The embodiments may also include but not be limited to applications wherein diamond particles are brazed directed to a backing plate 24, diamond impregnated segments are brazed to the backing plate 24, diamond particles are electroplated directly to the backing plate 24, or diamond impregnated resin bond pads are attached with the backing plate 24 by an adhesive process.

(2) Discussion

The present invention comprises a diamond trowel blade 20 that includes a backing plate 24 and a diamond bearing surface 22 for preparing a hardened concrete surface wherein the diamond bearing surface 22 may be attached with the backing plate 24. The backing plate 24 provides a stiff backing for the diamond bearing surface 22 to smooth rough concrete surface areas. A mounting means 26 may be attached with the backing plate 24. The mounting means 26 is useful for attaching the diamond trowel blade 20 with a typical power trowel. The backing plate 24 may be a round backing disc. In one embodiment the diamond trowel blade 20 comprises three or more round backing disc attached with the mounting means 26. The diamond bearing surface 22 is manufactured in several ways depending on how coarse or fine the grit of the diamond bearing surface 22 is desired and also depending on how rough the concrete surface is.

Figure 2A:
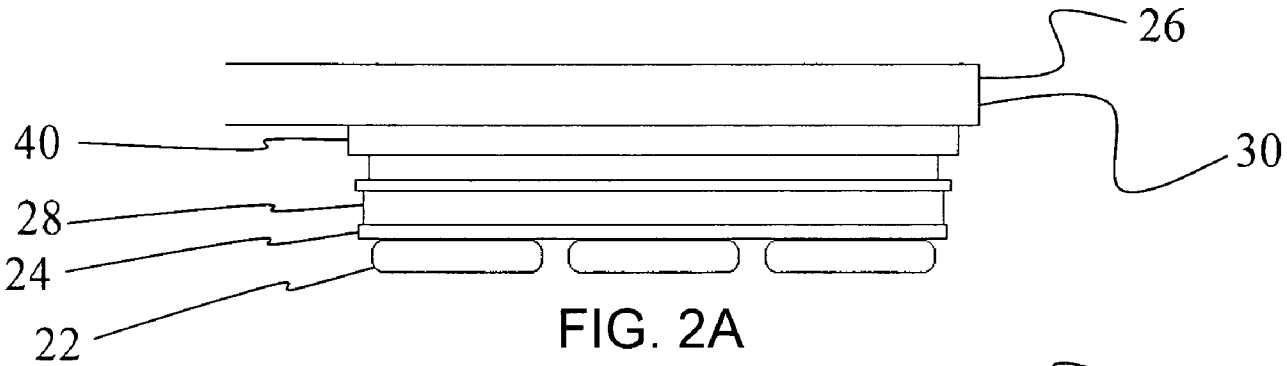
FIG. 2A is a side cut away view of the present invention depicting the diamond trowel blade.
Figure 2B:
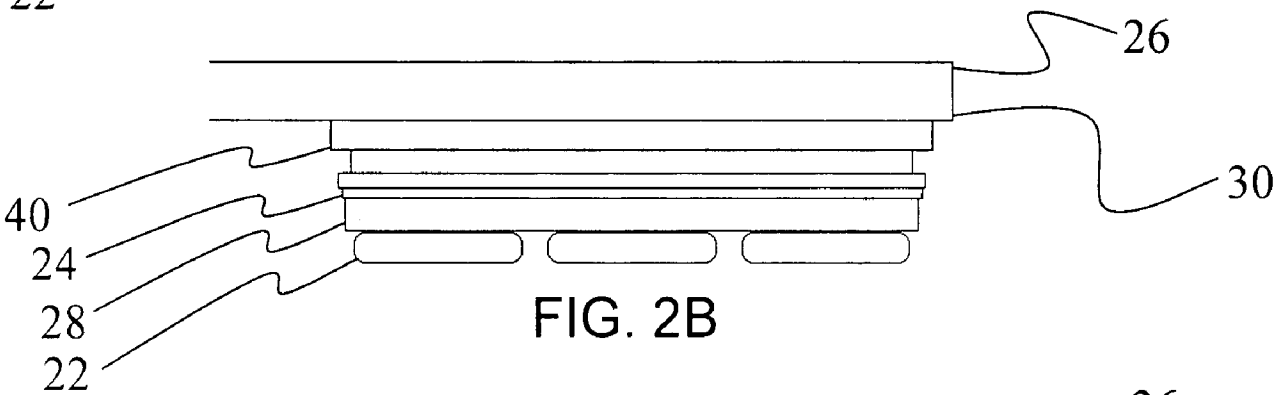
FIG. 2B is a side cut away view of another embodiment of the present invention depicting the diamond trowel blade.
Figure 2C:
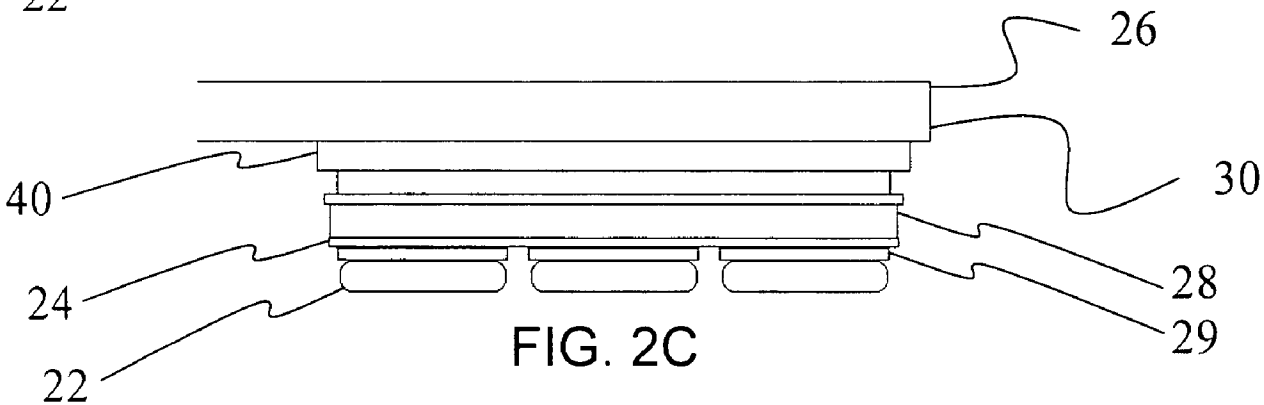
FIG. 2C is a side cut away view of yet another embodiment of the present invention depicting the diamond trowel blade.
Figure 3:
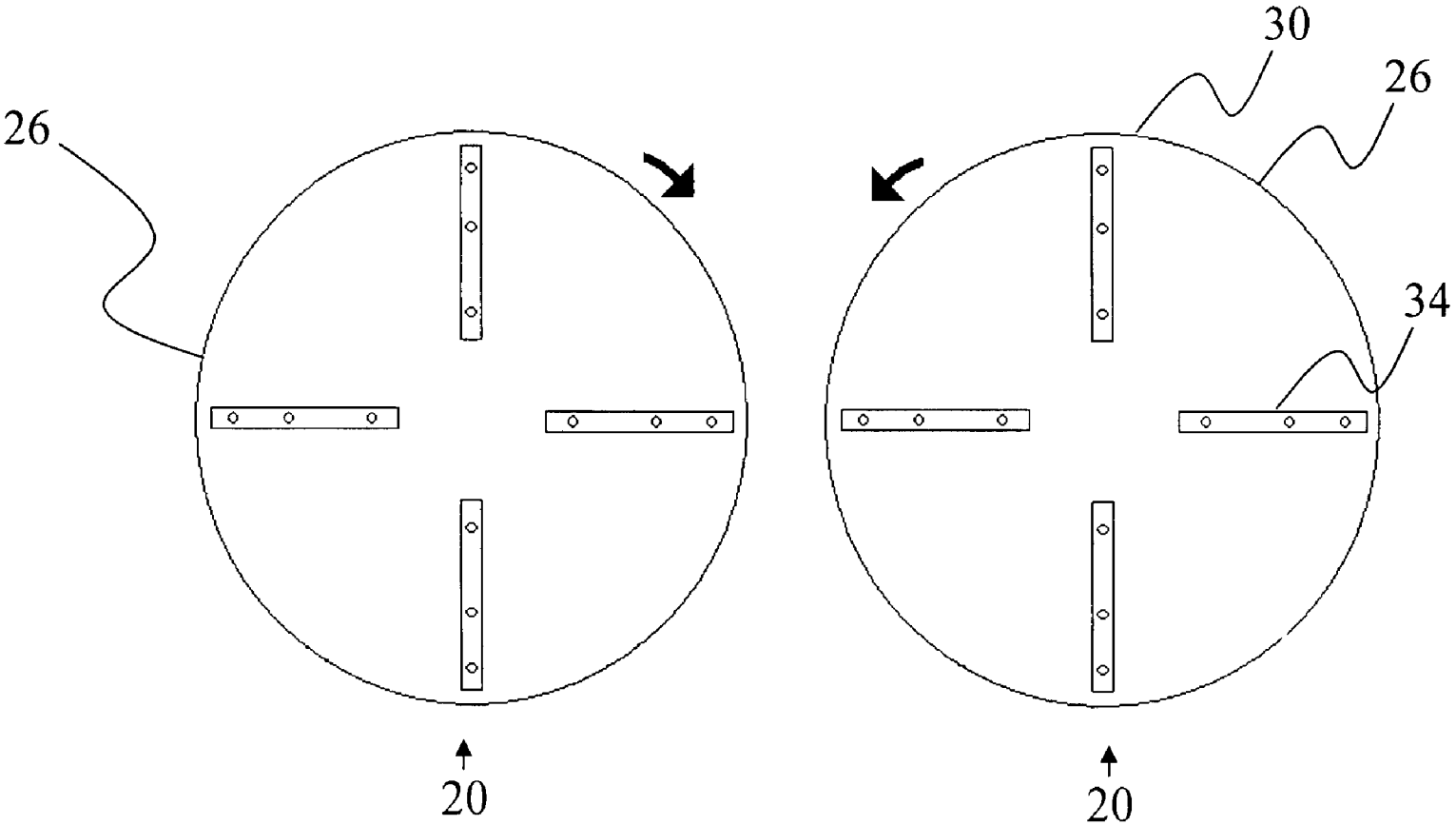
FIG. 3 is a top plan view of the present invention depicting an attachment means.
Figure 4:
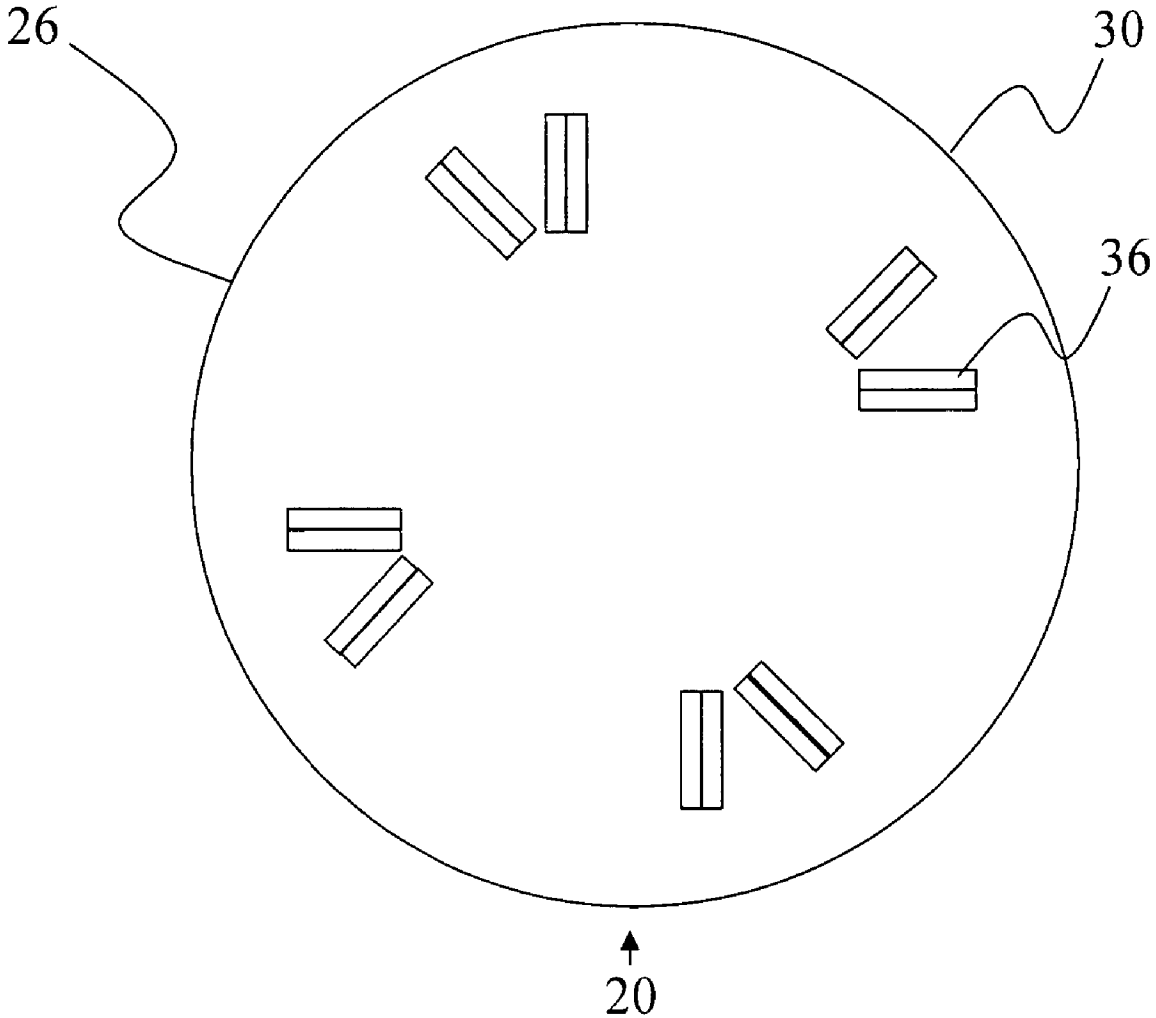
FIG. 4 is another top plan view of the present invention depicting another attachment means.

Another embodiment of the present invention is depicted in FIG. 2A. This embodiment of a diamond trowel blade 20 includes an intermediate layer 28. The intermediate layer 28 is useful for removing imperfections from rough concrete surfaces. Without the intermediate layer 28 it is difficult to get into voids and low spots in a rough concrete surface. The intermediate layer 28 may include but is not limited to a compliant material such as plastic or rubber material that is spongy or gives some on rough surfaces. Normally the intermediate layer is attached between the backing plate 24 and the mounting means 26. As depicted in FIG. 2B, the intermediate layer 28 may be attached directly below the backing plate 24 and directly above the diamond bearing surface 22. The intermediate layer 28 may also be attached directly below the mounting means 26 and directly above the backing plate 24. As shown in FIG. 2C, an intermediate layer 28 may be attached between the mounting means 26 and the backing plate 24 and a second intermediate layer 29 attached between the backing plate 24 and the diamond bearing surface 22.

The diamond trowel blade 20 may also comprise an attachment or mounting means 26 that is a round pan disc 30. The round backing disc 24 and the intermediate layer 28 may be attached with the mounting means 26 wherein the mounting means 26 further comprises a free rotating attachment 40 allowing the round backing disc to freely rotate independent of the rotating round pan disc 30. The free rotating attachment 40 may include but is not limited to radial bearings or linear bearings. The round pan disc 30 may be attached with the power trowel directly by removing the traditional trowel on the power trowel and attaching the round pan disc 30 directly with mounting arms 34. In another embodiment the round pan disc 30 may be attached with sleeves 36 on the round pan disc 30 that will slide over the traditional trowel on the power trowel.

Figure 5:
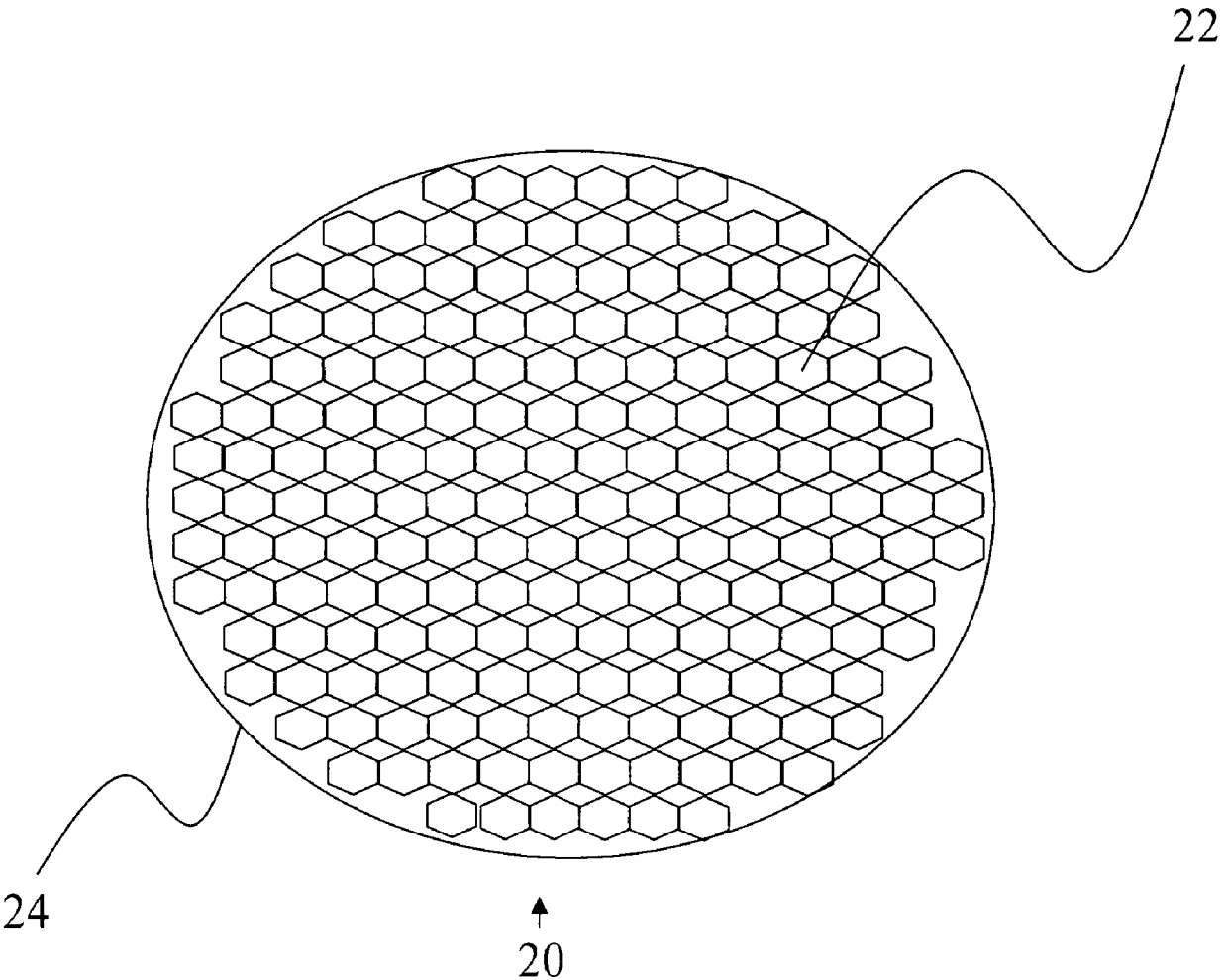
FIG. 5 is a bottom plan view of the present invention depicting the diamond bearing surface of one embodiment with resin bond pads.

FIG. 5 depicts another embodiment of a diamond trowel blade 20. In this embodiment the diamond bearing surface 22 is a diamond impregnated resin bond pad. Liquid resin is mixed with synthetic or natural diamonds and poured into a steel mold where the resin is pressed and heated for a period of time. The diamond impregnated resin bond pad is then released and fixed to the backing plate 24 by an adhesive process. The adhesive process may include but is not limited to a marine grade Velcro adhered to the backing plate 24 and the diamond impregnated resin bond pad. Another possible adhesive process is peel off adhesive material applied to the back of the diamond impregnated resin bond pad. The releasable paper may be removed from the adhesive and the diamond impregnated resin bond pad adhered to the backing plate 24.

Figure 6:
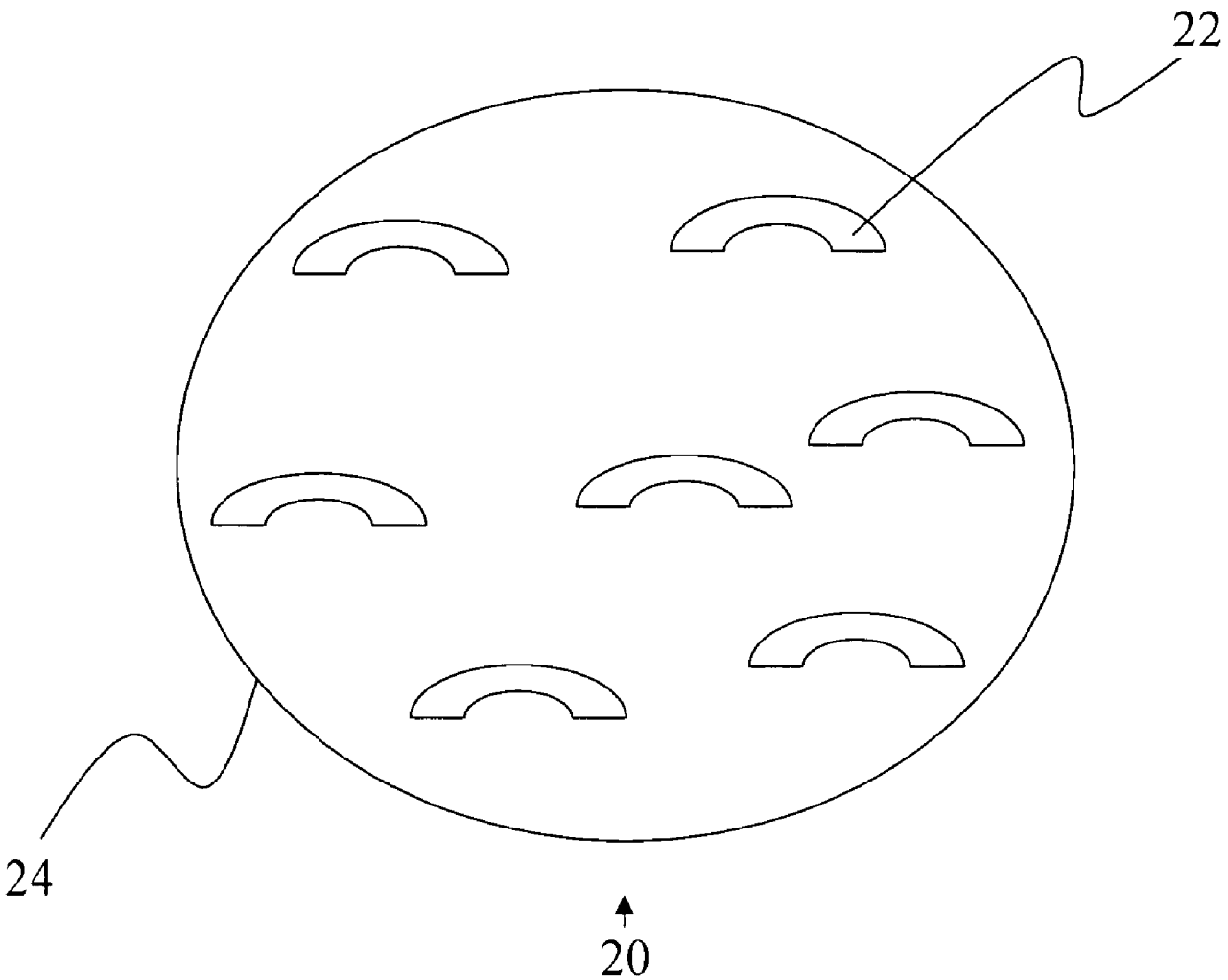
FIG. 6 is a bottom plan view of the present invention depicting the diamond bearing surface of one embodiment with diamond impregnated segments.

FIG. 6 depicts another embodiment of a diamond trowel blade 20 where the diamond bearing surface 22 consists of diamond impregnated segments. Powdered metal and synthetic or natural diamonds are compacted into graphite molds under pressure and heat until the desired hardness is obtained. The diamond impregnated segments are then brazed with silver solder to the backing plate 24 in a flat or horizontal position. Stone grinding machines may use a vertical mounting to the machine. However, for these concrete surface applications where the surface can be very rough, the diamond impregnated segments are mounted in the flat or horizontal position for durability.

Figure 7:
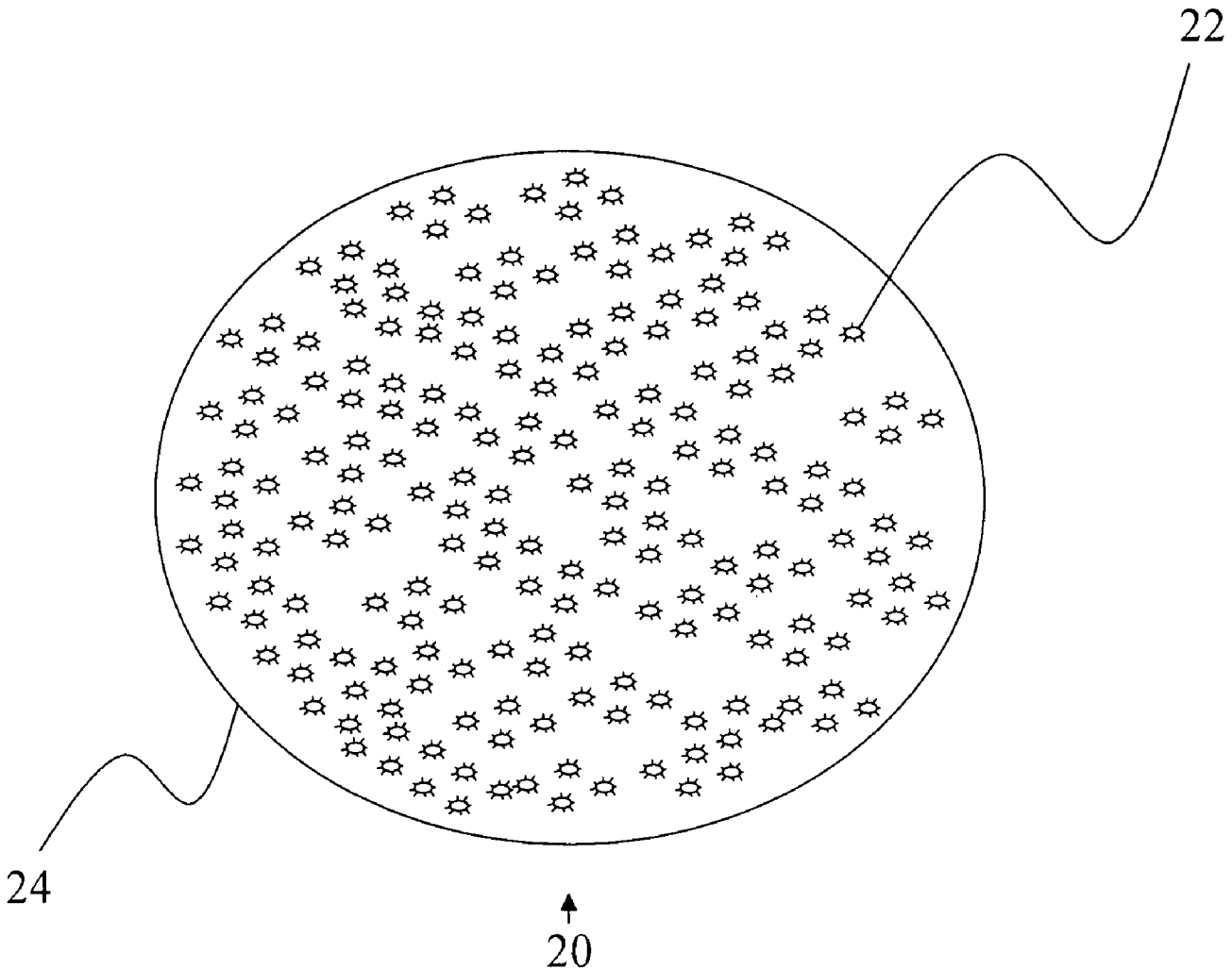
FIG. 7 is a bottom plan view of the present invention depicting the diamond bearing surface of one embodiment using electroplating.

As depicted in FIG. 7, in yet another embodiment of a diamond trowel blade 20 the diamond bearing surface 22 is electroplated synthetic or natural diamonds brazed under vacuum to backing plate 24.

Figure 8:
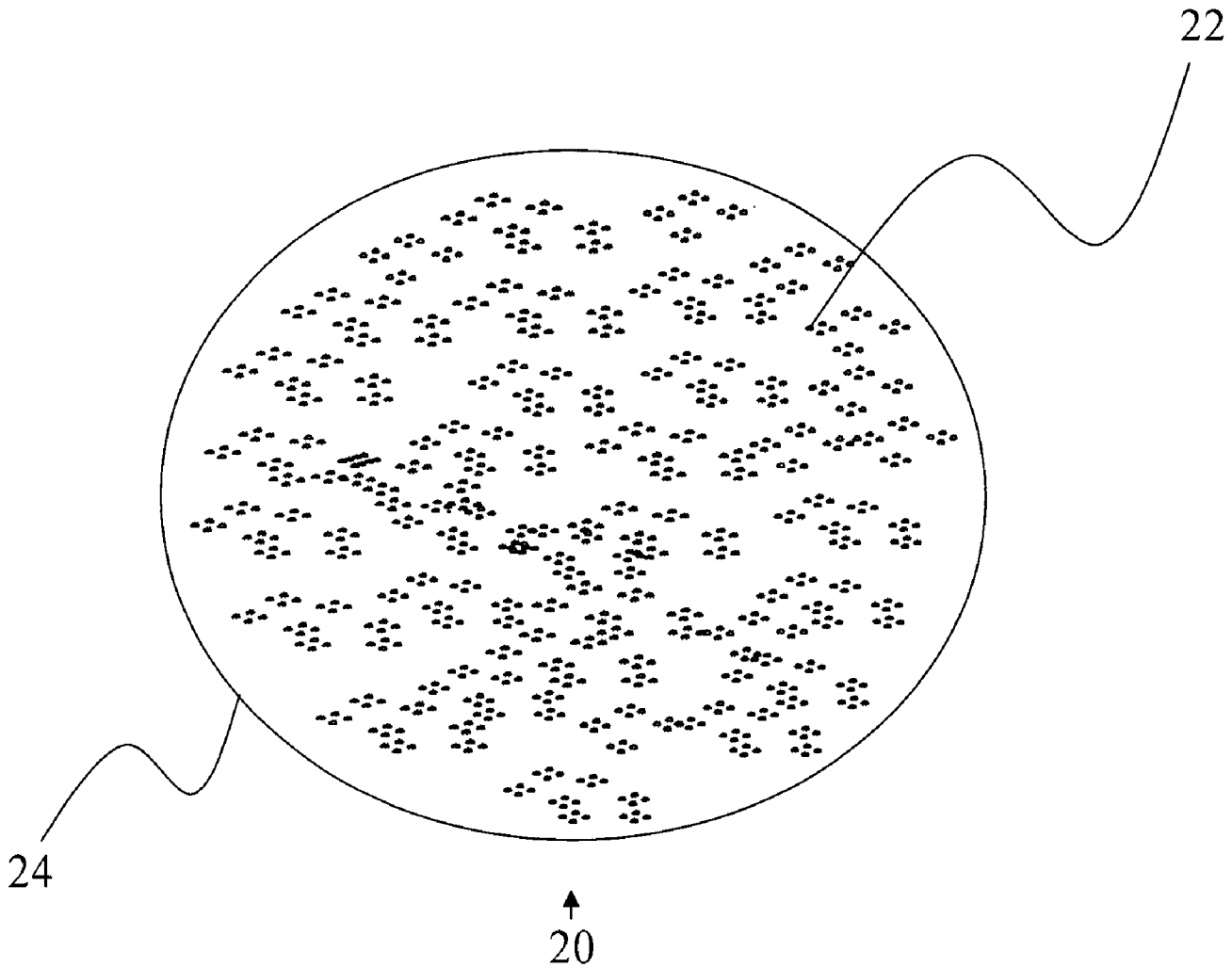
FIG. 8 is a bottom plan view of the present invention depicting the diamond bearing surface of one embodiment using chemical vapor deposition (CVD).

FIG. 8 depicts still another embodiment of a diamond trowel blade 20 comprises the diamond bearing surface 22 attached to backing plate 24 by chemical vapor deposition (CVD). In this embodiment fine diamond grit less than 10 microns is chemically bonded under vacuum to the steel trowel blade. This embodiment is useful for ultra fine concrete surface preparation.

(3) Manner of Use:

After pouring wet concrete the wet concrete is screeded, then the surface is floated, and next the surface is worked with a trowel to a smooth finish. For large areas the trowel work is accomplished with a power trowel machine that is either a walk behind or rideable type. Once the freshly poured concrete has hardened, the trowel machine and its corresponding flat blades will not sufficiently smooth the concrete surface. With color concrete flooring, the trowel machines may burn or take the color out of the color concrete floor if the trowel machine is used too long while trying to remove the imperfections. This may show up in the color concrete as the concrete turning a black shade of color. In lieu of burning the color concrete, the concrete flooring may be left to harden after the initial trowel work. Next as depicted in FIG. 1, the trowel machine with the diamond trowel blades 20 may be used for the final surface preparation. The user can prepare the concrete surface using different techniques and different types and grit of diamond trowel blades 20 depending on the roughness of the surface. For rough surfaces the user may select a very coarse grit of 30 to 40. The user can install the coarse grit diamond trowel blades 20 on the trowel machine and direct the rotating diamond trowel blades 20 over the surface. The user can change pads to a finer grit as the surface preparation process continues. A good surface is prepared with a 2,000 grit but the user may use up to a 10,000 grit diamond trowel blade 20. Typically, the user can start the surface preparation with a 300-500 grit diamond trowel blade 20. The method for mechanically preparing the concrete surface with a diamond trowel blade 20 includes the steps of attaching the diamond trowel blade 20 with round backing disc 30 to the power trowel using a round pan disc attachment means 26; selecting the diamond trowel blade 20 with the appropriate grit for the concrete surface; and directing the rotating diamond trowel blades 20 over the surface until the smoothness is attained for the particular grit of the diamond trowel blade 20 in use. Next if a smoother surface is desired, the user can repeat the steps for surface preparing until the user achieves the smoothness desired.

(4) Uniqueness:

The uniqueness of this invention is illustrated in many ways, five of which are as follows. First referring to FIG. 2A, the typical power trowel machine can be used with the diamond trowel blade 20 for concrete surface preparation once the concrete surface has hardened without having to purchase and maintain an expensive grinding machine. Second, the diamond trowel blade 20 may attach directly with the mounting of the typical power trowel machine using a mounting arm 34 that is more secure than a sleeve or clip on attachment; or a pan type trowel blade with a direct mounting, bolting directly to the power trowel; or a pan type trowel blade with a clip or sleeve 36 that slide over the current trowel blade of the power trowel. Third, the design of the diamond trowel blade 20 intermediate layer 28 allows for preparing rough surfaces by getting into holes and low spots to prepare these surfaces as well. Fourth, the use of the diamond trowel blade 20 on the typical power trowel utilizes two or three rotating units with a pan attachment 30 with each rotating unit or with four diamond trowel blades 20 per unit verses the many grinding machines that only have one rotating pad. Fifth, the manufacturing techniques allow for a variety of grit from very coarse to ultra Fine.

What is claimed is:

1. A trowel blade with diamond particles that will attach with a power trowel for surface preparation of hardened concrete, the trowel blade comprising:

a diamond bearing surface for preparing the concrete surface;

at least three backing discs each capable of receiving the diamond bearing surface;

a mounting means attached with a top side of the at least three backing discs for attaching the trowel blade with the power trowel wherein the mounting means comprises a round pan disc wherein the mounting means further comprises free rotating attachments on a lower side of the round pan disc for attaching the at least three backing discs with the round pan disc thereby allowing the at least three backing discs to freely rotate independent of the rotating round pan disc; and wherein the diamond bearing surfaces can be attached with a lower side of the at least three backing discs.

2. A trowel blade as set forth in claim 1, further comprising an intermediate layer attached between the at least three backing discs and the mounting means.

3. A trowel blade as set forth in claim 1, further comprising an intermediate layer attached between the at least three backing discs and the diamond bearing surface.

4. A trowel blade as set forth in claim 2, further comprising a second intermediate layer attached between the at least three backing discs and the diamond bearing surface.

5. A trowel blade as set forth in claim 2, wherein the intermediate layer is attached directly below the mounting means and directly above the at least three backing discs.

6. A trowel blade as set forth in claim 2, wherein the free rotating attachments on the lower side of the round pan disc comprise radial bearings.

7. A trowel blade as set forth in claim 2, wherein the free rotating attachments on the lower side of the round pan disc comprise linear bearings.

8. A trowel blade as set forth in claim 2, wherein the round pan disc further comprises a mounting arm attached with a top side of the round pan disc to attach the trowel blade round pan disc with the power trowel where the traditional trowel blade would attach to the power trowel.

9. A trowel blade as set forth in claim 2, wherein the round pan disc further comprises sleeves on a top side of the round pan disc to slide over the trowel blades of the power trowel attaching the round pan disc to the power trowel.

10. A trowel blade as set forth in claim 1, wherein the diamond bearing surface is a resin bond pad.

11. A trowel blade as set forth in claim 1, wherein the diamond bearing surface is diamond impregnated segments.

12. A trowel blade as set forth in claim 1, wherein the diamond bearing surface is electroplated synthetic diamonds.

13. A trowel blade as set forth in claim 1, wherein the diamond bearing surface is CVD (chemical vapor deposition).

14. A method for mechanically preparing a concrete surface with a diamond trowel blade attached with a power trowel, the method comprising the surface preparing steps of:

attaching the diamond trowel blade with at least three backing discs to the power trowel using a round pan disc attachment wherein the round pan disc attachment includes free rotating attachments for attaching each backing disc with the round pan disc;

selecting the diamond trowel blade with an appropriate grit for the concrete surface;

directing the rotating diamond trowel blade over the surface until the smoothness is attained for the particular grit of the diamond trowel blade in use; and repeating the steps of selecting, directing, and repeating until the user achieves the smoothness desired.

* * * * *